US009388545B1

(12) United States Patent
Wolner

(10) Patent No.: US 9,388,545 B1
(45) Date of Patent: Jul. 12, 2016

(54) DEVICE FOR RAISING AND LOWERING A STRUCTURE

(71) Applicant: J. Thomas Wolner, Red Wing, MN (US)

(72) Inventor: J. Thomas Wolner, Red Wing, MN (US)

( * ) Notice: Subject to any disclaimer, the term of this patent is extended or adjusted under 35 U.S.C. 154(b) by 0 days.

(21) Appl. No.: 14/167,492

(22) Filed: Jan. 29, 2014

Related U.S. Application Data

(60) Provisional application No. 61/758,522, filed on Jan. 30, 2013.

(51) Int. Cl.
*E02B 17/08* (2006.01)
*E02B 3/06* (2006.01)

(52) U.S. Cl.
CPC ..... *E02B 3/068* (2013.01)

(58) Field of Classification Search
CPC ..... E02B 17/08
USPC ..... 405/197
See application file for complete search history.

(56) References Cited

U.S. PATENT DOCUMENTS

| | | | | |
|---|---|---|---|---|
| 1,073,294 | A * | 9/1913 | Siewert | 254/103 |
| 1,975,049 | A | 9/1934 | Middlebrook | |
| 2,568,330 | A | 9/1951 | Flippin | |
| 2,861,430 | A | 11/1958 | Bauer et al. | |
| 3,278,158 | A | 10/1966 | Saldana | |
| 3,495,565 | A | 2/1970 | Gustavii | |
| 3,543,523 | A | 12/1970 | Nelson | |
| 3,614,871 | A | 10/1971 | Nordell | |
| 4,349,297 | A | 9/1982 | Misener | |
| 4,398,849 | A | 8/1983 | Moran et al. | |
| 4,641,596 | A | 2/1987 | Reprogle et al. | |
| 4,740,108 | A | 4/1988 | Levee et al. | |
| 4,793,275 | A | 12/1988 | Usher | |
| 4,878,450 | A | 11/1989 | Schmidt, Jr. | |
| 4,923,336 | A | 5/1990 | Schmidt | |
| 4,948,300 | A | 8/1990 | Bateson | |
| 4,981,397 | A | 1/1991 | Wiltse | |
| 4,983,067 | A | 1/1991 | Montgomery | |
| 5,020,463 | A | 6/1991 | Franklin et al. | |
| 5,046,897 | A * | 9/1991 | Ray | 405/221 |
| 5,138,965 | A | 8/1992 | Culp | |

(Continued)

FOREIGN PATENT DOCUMENTS

| | | |
|---|---|---|
| EP | 1643211 A2 | 4/2006 |
| FR | 2135446 | 12/1972 |

(Continued)

*Primary Examiner* — Tara M. Pinnock
(74) *Attorney, Agent, or Firm* — Dicke, Billig & Czaja, PLLC

(57) ABSTRACT

A device for raising and lowering a structure comprises a support, an adjustment mechanism, and a sensor mechanism. The support includes a first portion and a second portion configured and arranged to receive at least a portion of the first portion. The structure is operatively connected to the second portion. The adjustment mechanism interconnects the first portion and the second portion and is configured and arranged to move the second portion relative to the first portion thereby moving the structure relative to the first portion. The sensor mechanism is operatively connected to the adjustment mechanism and is configured and arranged to activate the adjustment mechanism under predetermined conditions. The sensor mechanism activates the adjustment mechanism to raise the second portion under a first predetermined condition and lower the second portion under a second predetermined condition.

11 Claims, 4 Drawing Sheets

(56) References Cited

U.S. PATENT DOCUMENTS

| | | | | | |
|---|---|---|---|---|---|
| 5,184,562 | A | * | 2/1993 | Hallin | 114/219 |
| 5,222,830 | A | | 6/1993 | Raguse | |
| 5,245,940 | A | | 9/1993 | Rockwood | |
| 5,341,757 | A | | 8/1994 | Digiacomo | |
| 5,406,713 | A | | 4/1995 | Oman et al. | |
| 5,551,366 | A | | 9/1996 | Kavanaugh | |
| 5,566,914 | A | * | 10/1996 | Thomas | 248/156 |
| 5,603,280 | A | * | 2/1997 | Shackelford, Jr. | E02B 3/24 114/230.27 |
| 5,692,857 | A | | 12/1997 | Ness | |
| 5,803,003 | A | * | 9/1998 | Vickers | 114/44 |
| 5,915,877 | A | * | 6/1999 | Sargent et al. | 405/3 |
| 5,988,093 | A | | 11/1999 | Ni | |
| 6,032,601 | A | | 3/2000 | Gates | |
| 6,361,252 | B1 | | 3/2002 | Leitheiser | |
| 6,746,181 | B1 | | 6/2004 | Heintz et al. | |
| 7,143,868 | B1 | | 12/2006 | Christen et al. | |
| 8,025,019 | B1 | * | 9/2011 | Katulka | E02B 3/26 114/220 |
| 2002/0166489 | A1 | | 11/2002 | Kapsner et al. | |
| 2004/0035343 | A1 | | 2/2004 | Floe et al. | |
| 2005/0034644 | A1 | | 2/2005 | Hamm | |
| 2006/0180069 | A1 | | 8/2006 | Stolzer | |
| 2009/0020057 | A1 | | 1/2009 | Johnson | |
| 2009/0067961 | A1 | | 3/2009 | Perez-Rodenas Espada | |
| 2010/0043425 | A1 | * | 2/2010 | Dragic | 60/504 |
| 2010/0229415 | A1 | * | 9/2010 | Knudsen | 33/613 |
| 2011/0146554 | A1 | | 6/2011 | Wright et al. | |

FOREIGN PATENT DOCUMENTS

| | | |
|---|---|---|
| GB | 1462047 | 1/1977 |
| JP | 58-81891 | 5/1983 |
| WO | WO0032467 | 6/2000 |
| WO | WO2007063224 | 6/2007 |
| ZA | 200808948 | 2/2009 |

* cited by examiner

DEVICE FOR RAISING AND LOWERING A STRUCTURE

BACKGROUND OF THE INVENTION

The present invention relates to a device for raising and lowering a structure such as but not limited to a dock in response to varying or changing water levels.

There are generally two types of docks, those that float up and down along fixed guide posts and those that are supported above the water on fixed posts. Floating docks can be problematic in rough waters and generally require more time to install and remove each season. Those docks that are supported above the water often have posts that are adjustable by some mechanism to account for changing water levels such as by a cable winch that can raise or lower the dock up and down the post or by a screw-driven telescopic post. These mechanisms for raising and lowering docks are effective only if someone is available to make adjustments as the water level changes. For these reasons, a more desirable method of maintaining a desirable dock level as water levels change is needed.

The present invention provides a mechanism for automatic adjustment of a dock level relative to changing water level that eliminates the drawbacks of floating docks and manually adjustable docks. Generally, the invention relates to boat docks but could apply to boardwalks, piers, or similar structures that are supported by supports or posts over water that may change in level. The supports or posts may include a foot or plate proximate the bottom that rests on the bottom of the body of water (a support surface such as but not limited to a lake bed, a river bed, etc.). The supports or posts could also include a wheel to facilitate removal of the dock that, along with the supports or posts, securely supports the dock above the water.

For the reasons stated above and for other reasons stated below, which will become apparent to those skilled in the art upon reading and understanding the present specification, there is a need in the art for a device for raising or lowering a structure such as but not limited to a dock in response to varying or changing water levels.

BRIEF SUMMARY OF THE INVENTION

The above-mentioned problems associated with prior devices are addressed by embodiments of the present invention and will be understood by reading and understanding the present specification. The following summary is made by way of example and not by way of limitation. It is merely provided to aid the reader in understanding some of the aspects of the invention.

In one embodiment, a device for raising and lowering a structure comprises a support, an adjustment mechanism, and a sensor mechanism. The support includes a first portion and a second portion configured and arranged to receive at least a portion of the first portion. The structure is operatively connected to the second portion. The adjustment mechanism interconnects the first portion and the second portion and is configured and arranged to move the second portion relative to the first portion thereby moving the structure relative to the first portion. The sensor mechanism is operatively connected to the adjustment mechanism and is configured and arranged to activate the adjustment mechanism under predetermined conditions. The sensor mechanism activates the adjustment mechanism to raise the second portion under a first predetermined condition and lower the second portion under a second predetermined condition.

In one embodiment, a device for raising and lowering a structure in response to changing water levels comprises a support, a connecting member, an adjustment mechanism, and a sensor mechanism. The support includes a first portion and a second portion configured and arranged to receive at least a portion of the first portion. The structure is operatively connected to the second portion. The connecting member is operatively connected to the structure and to the first portion. The adjustment mechanism interconnects the first portion and the second portion and is configured and arranged to move the second portion relative to the first portion thereby moving the structure relative to the first portion. The sensor mechanism is operatively connected to the adjustment mechanism and is configured and arranged to activate the adjustment mechanism under predetermined conditions. The sensor mechanism activates the adjustment mechanism to raise the second portion under a first predetermined condition and lower the second portion under a second predetermined condition.

In one embodiment, a device for raising and lowering a structure in response to changing water levels comprises a post, a connecting member, a nut, a gearbox, a drive screw, a motor assembly, a controller, and sensors. The post includes an inner leg and an outer leg. The outer leg is configured and arranged to receive at least a portion of the inner leg and is operatively connected to the structure. The inner leg has an inner leg top portion and an inner leg bottom portion. The outer leg has an outer leg top portion. The connecting member is operatively connected to the structure and to the inner leg bottom portion. The nut is operatively connected to the inner leg top portion. The gearbox is operatively connected to the outer leg top portion. The drive screw interconnects the nut and the gearbox. The motor assembly is operatively connected to the drive screw. The controller is operatively connected to the motor assembly. A high water level sensor and a low water level sensor are operatively connected to the outer leg and are configured and arranged to provide input to the controller. The high water level sensor activates the controller to move the outer leg relative to the inner leg to lengthen the post under a first predetermined condition, and the low water level sensor activates the controller to move the outer leg relative to the inner leg to shorten the post under a second predetermined condition.

BRIEF DESCRIPTION OF THE DRAWINGS

The present invention can be more easily understood, and further advantages and uses thereof can be more readily apparent, when considered in view of the detailed description and the following Figures in which.

In accordance with common practice, the various described features are not drawn to scale but are drawn to emphasize specific features relevant to the present invention. Reference characters denote like elements throughout the Figures and the text.

DETAILED DESCRIPTION OF THE INVENTION

In the following detailed description, reference is made to the accompanying drawings, which form a part hereof, and in which is shown by way of illustration embodiments in which the inventions may be practiced. These embodiments are described in sufficient detail to enable those skilled in the art to practice the invention, and it is to be understood that other embodiments may be utilized and mechanical changes may be made without departing from the spirit and scope of the present invention. The following detailed description is, therefore, not to be taken in a limiting sense, and the scope of the present invention is defined only by the claims and equivalents thereof.

Embodiments of the present invention provide for devices for raising and lowering structures such as but not limited to docks, boardwalks, piers, or similar structures in response to varying or changing water levels.

Figure 1:
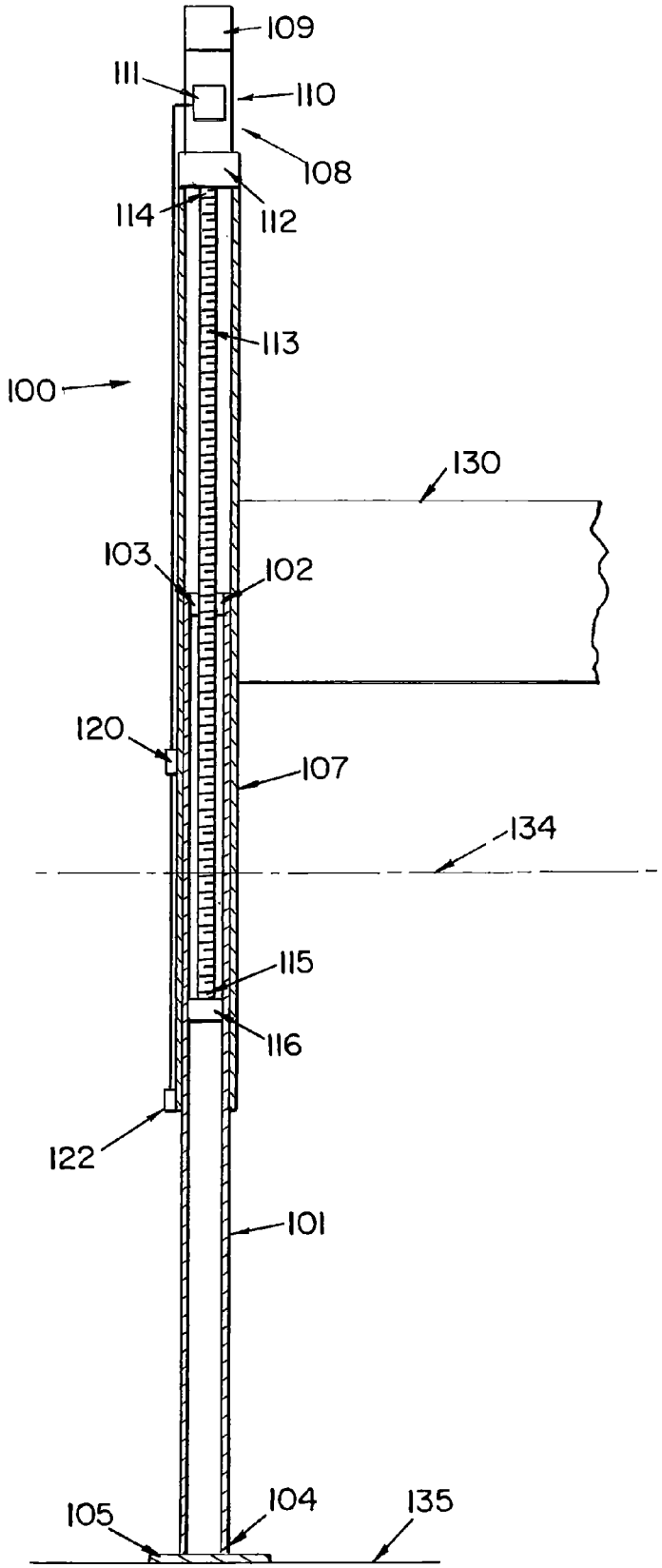
FIG. 1 is a cross-section view of a support constructed in accordance with the present invention.

One embodiment of the present invention utilizes a telescopic post 100 shown in FIG. 1 as a support. A threaded drive screw 113, or other suitable elongate member, is part of an adjustment mechanism used to adjust a length of the telescopic post 100. A threaded nut 103, or other suitable guide member, is operatively connected to the top 102 of a lower, inner leg 101 (first portion) of the post 100 through which the threaded drive screw 113 extends. The threaded drive screw 113 includes a first, upper end 114 and a second, lower end 115. The second, lower end 115 of the drive screw 113 includes a guide 116 to help stabilize the second, lower end 115 of the drive screw 113 within a bore of the lower, inner leg 101. The top 108 of the upper, outer leg 107 (second portion) is configured and arranged to support a gearbox 112 and a motor assembly 110 including a motor controller 111 that are operatively connected to the drive screw 113, which are components of the adjustment mechanism. The inner leg 101 telescopes into and out of the outer leg 107 in response to rotation of the threaded drive screw 113. This telescopic movement in turn raises or lowers the dock 130 or other structure, which is attached to the outer leg 107, relative to the lake bed 135 or support structure and the water level 134. The inner leg 101 includes a foot 105 operatively connected to the bottom 104, but it is recognized that the foot 105 could be replaced by a wheel or other suitable structure. Also attached to the outer leg 107 is a sensor mechanism, which includes two sensors, that is operatively connected to the motor controller 111. One sensor is located below the water level 134 and is designated as the low water sensor 122 and the other sensor is located above the water level 134 and is designated as the high water sensor 120. In this embodiment, a rechargeable battery 109 supplies power to the motor assembly 110, the motor controller 111, and the sensors 120 and 122 as needed, however, other methods of supplying power well known in the art could be used.

The sensors 120 and 122 monitor water level 134, which varies, relative to the dock 130. If the water level 134 drops below the low water sensor 122, the motor controller 111 receives a signal to start the motor assembly 110 and turn the drive screw 113 in a direction that will lower the dock 130 a predetermined amount by retracting the inner leg 101 until the low water sensor 122 is again submerged. In a similar fashion, the high water sensor 120, once submerged, sends a single to the motor controller 111 to start the motor assembly 110 and turn the drive screw 113 in a direction that will raise the dock 130. Logic is programmed into the motor controller 111 such that the dock 130 does not move up or down until certain conditions are met. For example, if the low water sensor 122 becomes intermittently exposed, the controller 111 would not take action to lower the dock 130. However, if the exposure time period becomes long enough, the controller 111 would start the motor assembly 110 to lower the dock 130 a predetermined amount and then reevaluate the signal from the low water sensor 122. This process would repeat until a steady state signal is reached. Likewise, the dock 130 would not be raised by the motor assembly 110 until a steady state signal is received by the controller 111 for a predetermined period of time that the high water sensor 120 is submerged. The dock 130 would then be raised a predetermined amount and the signal from the high water sensor 120 reevaluated. The drive screw 113 turns slowly such that the dock 130 moves up or down at a very slow rate to avoid any risk of injury.

Figure 2:
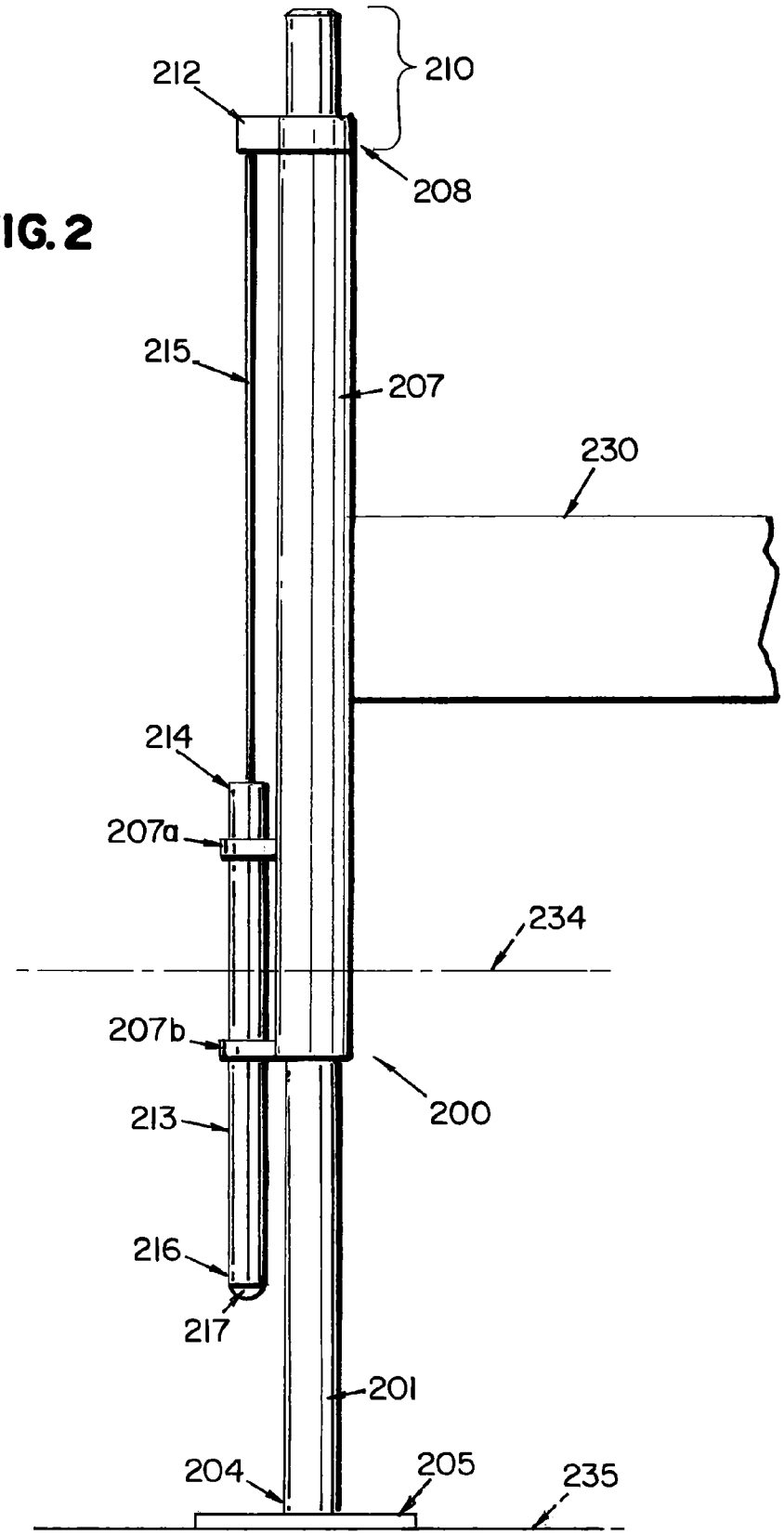
FIG. 2 is a schematic representation of another embodiment support constructed in accordance with the present invention.

Another embodiment is shown in FIG. 2. The support is a telescopic post 200 including an inner leg 201 and an outer leg 207. The inner leg 201 includes a bottom 204 with a foot 205 configured and arranged to be supported by the lake bed 235. The outer leg 207 is configured and arranged to receive the inner leg 201 and is operatively connected to the dock 230. The outer leg 207 includes a top 208 to which a motor and gearbox assembly 210 and a three-way switch 212 are operatively connected. The outer leg 207 also includes guides 207*a* and 207*b* proximate its bottom. The guides 207*a* and 207*b* are configured and arranged to receive an elongate float member 213. The elongate float member 213 includes a top 214 to which a rod 215 is operatively connected and a bottom 216 to which a weight 217 is operatively connected. The rod 215 interconnects the elongate float member 213 and the three-way switch 212, which is operatively connected to the motor and gearbox assembly 210.

The motor and gearbox assembly 210 operates similarly to the previous embodiment. The motor turns the gearbox to rotate the drive screw (not shown in this embodiment) in either a first direction or a second direction to raise or lower the dock in response to the position of the three-way switch 212.

The three-way switch 212 is positioned in the center position (off position) if the dock 230 is at the desired level above the water level 234. If the water level 234 drops, less of the elongate float member 213 is in the water resulting in less buoyant force, which pulls the three-way switch 212 in the down position to lower the dock 230. If the water level 234 rises, more of the elongate float member 213 is in the water resulting in more buoyant force, which pushes upward with more force and pushes the three-way switch 212 in the up position to raise the dock 230. The weight 217 at the bottom 216 of the elongate float member 213 helps to dampen the movement some but another damping mechanism may be needed to reduce any effects of waves. This mechanical mechanism is an alternative to the motor controller 111 of the previous embodiment.

Figure 3:
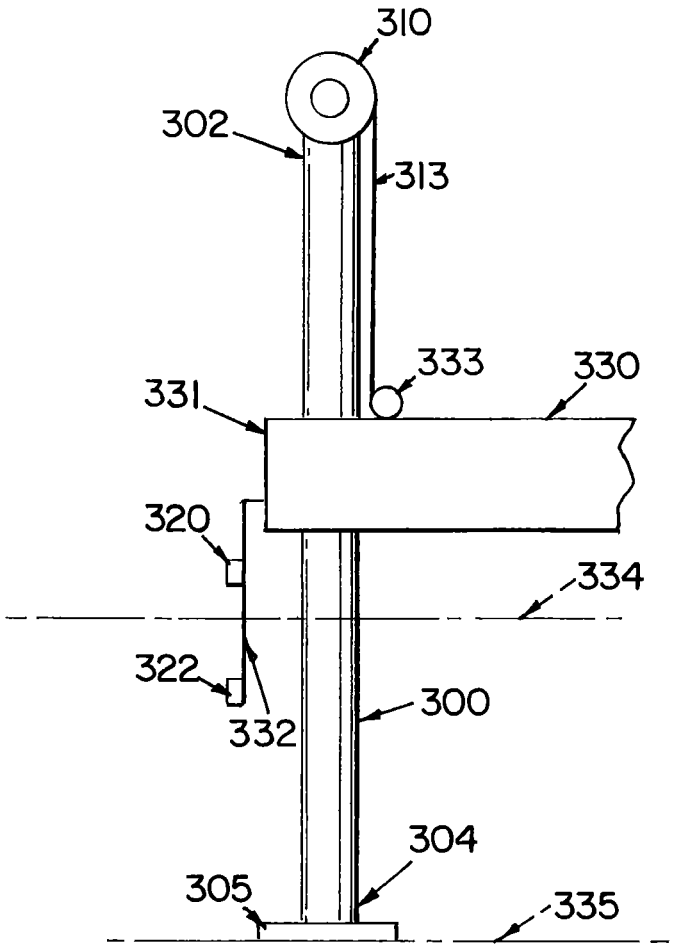
FIG. 3 is a schematic representation of another embodiment support constructed in accordance with the present invention.

Another embodiment is shown in FIG. 3. The support is an elongate member such as a post 300 including an intermediate portion interconnecting a top 302 and a bottom 304 including a foot 305 configured and arranged to be supported by a lake bed 335. A winch with a motor and a gearbox assembly 310 is operatively connected to the top 302 of the post 300. A dock 330 includes a guide 331 operatively connected to one end configured and arranged to move along a length of the post 300. The guide 331 includes a bore through which the post 300 extends, and the guide 331 is positioned proximate the intermediate portion of the post 300. An extension 332 is operatively connected to the end of the guide 331 opposite the end connected to the dock 330. The extension 332 extends outward and then downward and includes a sensor mechanism having a high water sensor 320 proximate its top and a low water sensor 322 proximate its bottom. The water sensors 320 and 322 sense the water level 334. Proximate the guide 331 is a connector such as a lifting eye 333 operatively connected to at least one of the guide 331 and the dock 330. A cable 313 interconnects the lifting eye 333 and the winch with a motor and a gearbox assembly 310. The post 300 is not telescopic. Rather, the guide 331 moves along the post 300.

If the water level 334 drops, the winch with a motor and a gearbox assembly 310 will pay out additional cable 313 to lower the dock 330, and the guide 331 will move downward along the post 300. If the water level 334 rises, the winch with a motor and a gearbox assembly 310 will wind cable 313 about the drum of the winch to raise the dock 330, and the guide will move upward along the post 300.

Figure 4:
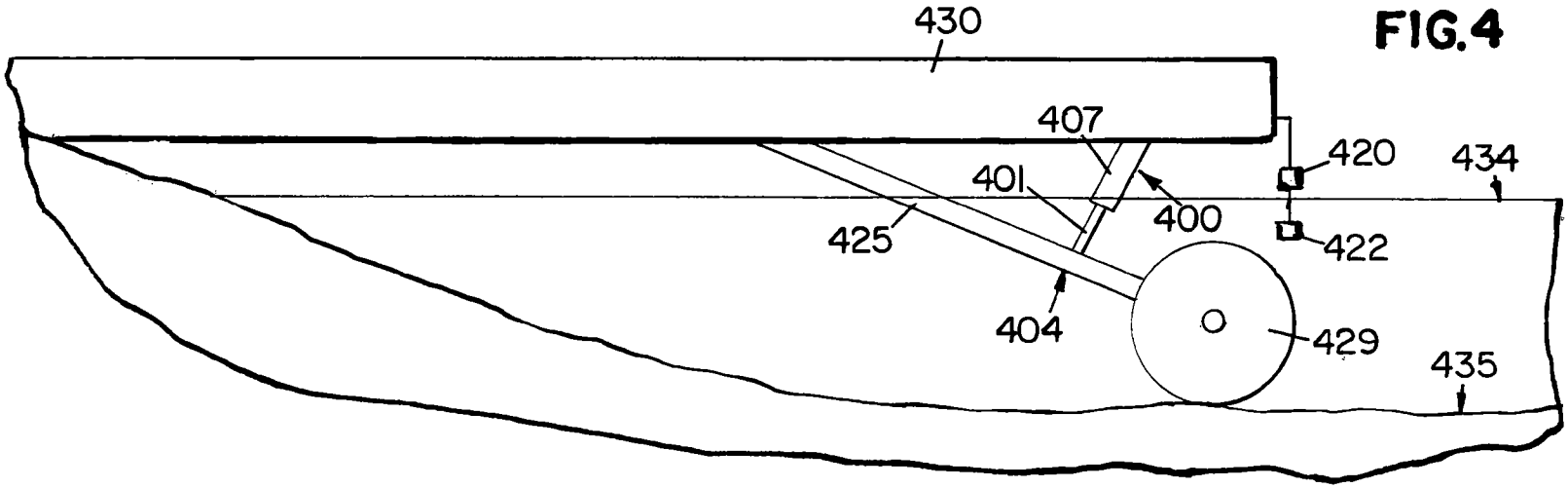
FIG. 4 is a schematic representation of another embodiment support constructed in accordance with the present invention.
Figure 5:
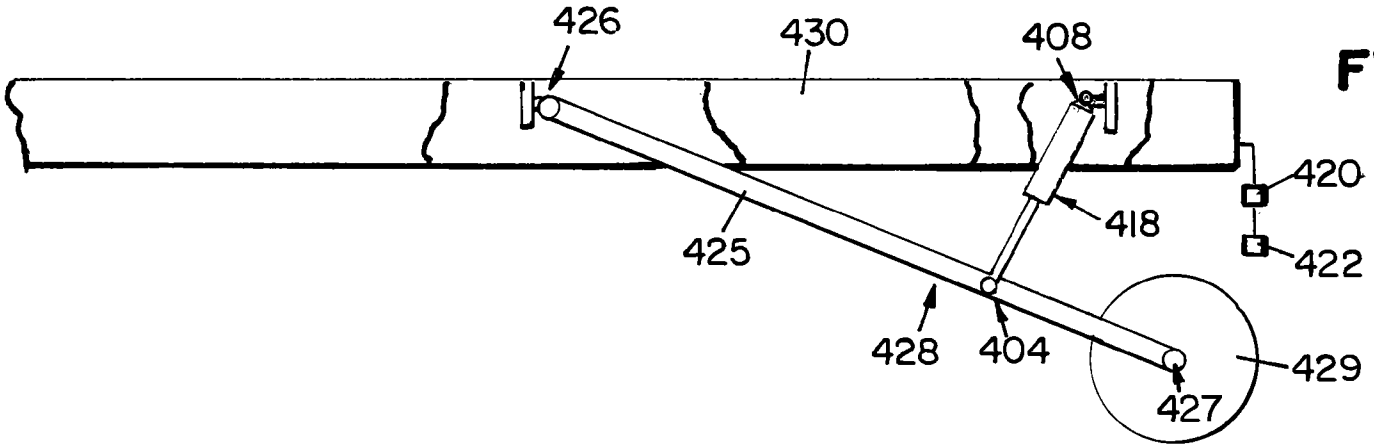
FIG. 5 is a schematic, partial cross-section view of the support shown in FIG. 4.

Another embodiment is shown in FIGS. 4 and 5. The support is an elongate member such as a post 400 including an inner leg 401 and an outer leg 407 interconnecting a dock 430 and an intermediate portion 428 of a connecting member 425. The inner leg 401 is shown connected to the intermediate portion 428 and the outer leg 407 is shown connected to the dock 430, but these could be switched. The connecting member 425 includes a first end 426 pivotally connected to the dock 430 and a second end 427 operatively connected to a wheel mechanism 429, which assists in moving the dock 430 relative to the lake bed 435 or support structure.

A threaded drive screw (not shown), or other suitable elongate member, is part of an adjustment mechanism used to adjust a length of the post 400. The adjustment member is similar to that shown in FIG. 1 and is therefore not shown in detail. It is recognized that other adjustment members could be used. A threaded nut (not shown), or other suitable guide member, is operatively connected to the top of the inner leg 401 (first portion) of the post 400 through which the threaded drive screw extends. The threaded drive screw includes a first end and a second end. The second end of the drive screw includes a guide to help stabilize the second end of the drive screw within a bore of the inner leg 401. The top 408 of the outer leg 407 (second portion) is configured and arranged to support a gearbox (not shown) and a motor assembly (not shown) including a motor controller (not shown) that are operatively connected to the drive screw, which are components of the adjustment mechanism. The inner leg 401 telescopes into and out of the outer leg 407 in response to rotation of the threaded drive screw. This telescopic movement in turn raises or lowers the dock 430 or other structure, which is attached to the outer leg 407, relative to the lake bed 435 or support structure and the water level 434. The inner leg 401 is operatively connected to the wheel mechanism 429 via the connecting member 425. Also operatively connected to the outer leg 407 is a sensor mechanism, which includes two sensors, that is operatively connected to the motor controller. One sensor is located below the water level 434 and is designated as the low water sensor 422 and the other sensor is located above the water level 434 and is designated as the high water sensor 420. In this embodiment, a rechargeable battery (not shown) supplies power to the motor assembly, the motor controller, and the sensors 420 and 422 as needed, however, other methods of supplying power well known in the art could be used.

The sensors 420 and 422 monitor water level 434, which varies, relative to the dock 430. If the water level 434 drops below the low water sensor 422, the motor controller receives a signal to start the motor assembly and turn the drive screw in a direction that will lower the dock 430 a predetermined amount by retracting the inner leg 401 until the low water sensor 422 is again submerged. This decreases the length of the post 400 thereby decreasing the distance between the dock 430 and the intermediate portion 428 of the connecting member 425 connected by the post 400. In a similar fashion, the high water sensor 420, once submerged, sends a single to the motor controller to start the motor assembly and turn the drive screw in a direction that will raise the dock 430. This increases the length of the post 400 thereby increasing the distance between the dock 430 and the intermediate portion 428 of the connecting member 425 connected by the post 400. The first end 426 of the connecting member 425 pivots relative to the dock 430 as the post 400 either decreases or increases in length. In this embodiment, the end of the dock 430 contacting the shore acts as a pivot point for the dock 430 as the opposite end of the dock 430 is lowered or raised. It is recognized that other types of connecting members could be used such as a scissor-like arrangement or a parallelogram-like arrangement to assist in moving the dock upward or downward and including a wheel mechanism with these alternative connecting members is optional.

Logic is programmed into the motor controller such that the dock 430 does not move up or down until certain conditions are met. For example, if the low water sensor 422 becomes intermittently exposed, the controller would not take action to lower the dock 430. However, if the exposure time period becomes long enough, the controller would start the motor assembly to lower the dock 430 a predetermined amount and then reevaluate the signal from the low water sensor 422. This process would repeat until a steady state signal is reached. Likewise, the dock 430 would not be raised by the motor assembly until a steady state signal is received by the controller for a predetermined period of time that the high water sensor 420 is submerged. The dock 430 would then be raised a predetermined amount and the signal from the high water sensor 420 reevaluated. The drive screw turns slowly such that the dock 430 moves up or down at a very slow rate to avoid any risk of injury.

It is recognized that other devices for raising and lowering a structure are possible. Another example includes a rack and a pinion drive arrangement mounted to a support. Other sensor arrangements are also possible such as a float switch mounted to the underside of the dock. It would also be possible to have more than one set of wheel mechanisms for adjusting the height of a longer or continuous dock or structure that operate independently or together. One motor controller could control several supports such that all supports move in unison and at an even rate, keeping the dock level. A user control switch could also be incorporated such that the dock could be raised or lowered on demand. A back-up manual means could also be incorporated to raise or lower the dock should there be a power failure to the motor. It could be arranged such that one motor drives two or more supports. The invention is not limited to these examples as it is recognized that other options are possible.

The above specification, examples, and data provide a complete description of the manufacture and use of the composition of embodiments of the invention. Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the invention. Therefore, it is manifestly intended that this invention be limited only by the claims and the equivalents thereof.

The invention claimed is:

1. A device for raising and lowering a structure, comprising:

a support including a first portion and a second portion configured and arranged to receive at least a portion of the first portion, the second portion being configured and arranged to be operatively connected to the structure;

a connecting member configured and arranged to be operatively connected to the structure and to the first portion, wherein the connecting member has an intermediate portion interconnecting a first end and a second end, the first end being operatively connected to the structure, the second end being operatively connected to a wheel mechanism, the intermediate portion being operatively connected to the first portion;

an adjustment mechanism interconnecting the first portion and the second portion and configured and arranged to move the second portion relative to the first portion thereby moving the structure relative to the first portion; and a sensor mechanism operatively connected to the adjustment mechanism and configured and arranged to activate the adjustment mechanism under predetermined conditions, the sensor mechanism activating the adjustment mechanism to raise the second portion under a first predetermined condition and lower the second portion under a second predetermined condition.

2. The device of claim 1, wherein the support is a post, the first portion is an inner leg, and the second portion is an outer leg.

3. The device of claim 1, wherein the adjustment mechanism includes a motor assembly, a motor controller, a gearbox, and a drive screw.

4. The device of claim 3, wherein the motor assembly is powered by a battery.

5. The device of claim 4, wherein the battery is a rechargeable battery.

6. The device of claim 3, wherein the drive screw is driven by the gearbox, the motor assembly, and the motor controller.

7. The device of claim 3, wherein the motor controller is logic-programmed to raise and lower the structure in response to inputs from the sensor mechanism.

8. The device of claim 1, wherein the sensor mechanism includes a high water sensor and a low water sensor to raise and lower the structure in response to changing water levels.

9. A device for raising and lowering a structure in response to changing water levels, comprising:

a post including an inner leg and an outer leg, the outer leg configured and arranged to receive at least a portion of the inner leg, the outer leg being configured and arranged to be operatively connected to the structure, the inner leg having an inner leg top portion and an inner leg bottom portion, the outer leg having an outer leg top portion;

a connecting member configured and arranged to be operatively connected to the structure and to the inner leg bottom portion;

a nut operatively connected to the inner leg top portion;

a gearbox operatively connected to the outer leg top portion;

a drive screw interconnecting the nut and the gearbox;

a motor assembly operatively connected to the drive screw;

a controller operatively connected to the motor assembly; and a high water level sensor and a low water level sensor operatively connected to the outer leg and configured and arranged to provide input to the controller, the high water level sensor activating the controller to move the outer leg relative to the inner leg to lengthen the post under a first predetermined condition, the low water level sensor activating the controller to move the outer leg relative to the inner leg to shorten the post under a second predetermined condition.

10. The device of claim 9, wherein the controller is selected from the group consisting of a motor controller and a three-way switch.

11. The device of claim 9, wherein the connecting member has an intermediate portion interconnecting a first end and a second end, the first end being operatively connected to the structure, the second end being operatively connected to a wheel mechanism, the intermediate portion being operatively connected to the inner leg bottom portion.

* * * * *